US005090112A

United States Patent [19]

Bensch et al.

[11] Patent Number: 5,090,112

[45] Date of Patent: Feb. 25, 1992

[54] METHOD AND APPARATUS FOR MANUFACTURING COILS

[75] Inventors: Günther Bensch, Stein; Markus Schneider, Herrieden; Bert Walch, Schwabach; Martin Schmidt, Nuremberg, all of Fed. Rep. of Germany

[73] Assignee: Robert Bosch GmbH, Stuttgart, Fed. Rep. of Germany

[21] Appl. No.: 576,387

[22] PCT Filed: Feb. 25, 1989

[86] PCT No.: PCT/DE89/00111

§ 371 Date: Sep. 14, 1990

§ 102(e) Date: Sep. 14, 1990

[87] PCT Pub. No.: WO89/11155

PCT Pub. Date: Nov. 16, 1989

[30] Foreign Application Priority Data

May 7, 1988 [DE] Fed. Rep. of Germany ..... 3815676

[51] Int. Cl.[5] ..... H01F 7/06

[52] U.S. Cl. ..... 29/605; 29/593; 29/618; 72/378; 242/7.12

[58] Field of Search ..... 29/605, 618, 593; 242/7.03, 7.07, 7.12; 72/378; 336/222, 223; 338/261, 267, 270

[56] References Cited

U.S. PATENT DOCUMENTS

| | | | |
|---|---|---|---|
| 1,839,801 | 1/1932 | Northrup | 336/223 |
| 3,100,554 | 8/1963 | Doubek, Jr. | 242/7.12 |
| 3,458,929 | 8/1969 | Gilbertson | 242/7.12 |
| 4,352,465 | 10/1982 | Grechanliisky et al. | 242/7.12 |
| 4,625,927 | 12/1986 | Arnold | 29/605 |

FOREIGN PATENT DOCUMENTS

| | | |
|---|---|---|
| WO80/01432 | 7/1980 | U.S.S.R. . |
| 2104252A | 3/1983 | United Kingdom . |

OTHER PUBLICATIONS

Soviet Inventions Illustrated Derwent week 84/25 issued Aug. 1, 1984, and SU-A-1046-787.

Patent Abstracts of Japan, vol. 5, No. 38 (P-52) 710, Mar. 12, 1981 and JP-A-55 162002, dated Dec. 17, 1980.

Patent Abstracts of Japan, vol. 12, No. 254 (E-634) 3101, Jul. 16, 1988, and JP-A-63 42107, dated Feb. 23, 1988.

Patent Abstracts of Japan, vol. 9, No. 255 (E-349) 1978, Oct. 12, 1985, and JP-A-60 105210, dated Jun. 10, 1985.

*Primary Examiner*—P. W. Echols

*Attorney, Agent, or Firm*—Kenyon & Kenyon

[57] ABSTRACT

A method and apparatus for manufacturing coils made of resistance wire, wherein the coil's electrical resistance can be preselected despite variations in the resistance of the wire being used, or changes in the ambient temperature of the wire during manufacturing. The wire is supplied to a winding device through an electrically controlled wire braking element which has an electrically adjustable braking force. The resistance of at least one coil wire section is measured; the measuring signal is supplied to an evaluating configuration, wherein the actual measured resistance value is compared to a preselected desired value; and a signal is transmitted to the braking element to decrease the braking action when the measured resistance value exceeds the desired resistance value, and a signal is transmitted to the braking element to increase the braking action when the desired value is undershot.

22 Claims, 1 Drawing Sheet

METHOD AND APPARATUS FOR MANUFACTURING COILS

FIELD OF THE INVENTION

The present invention relates to methods and apparatus for manufacturing coils and, in particular, to methods and apparatus for manufacturing coils of resistance wire.

BACKGROUND OF THE INVENTION

Coils having a preselected resistance value are used for various applications, such as current coils for injection valves. One problem in manufacturing these types of coils with conventional automatic winding machines, is that the resistance value of the wire typically does not remain constant along the entire length of the coil. For example, there may be variations in the alloy of the base material, or various conditions during the process of drawing the wire, that may cause the resistance of the wire to vary. The resistance of a wound coil is also influenced by the ambient conditions during the process of winding the coil, such as the room temperature.

It is an object of the present invention, therefore, to overcome the problems of known methods and apparatus for manufacturing coils and to provide coils having substantially predetermined electrical resistance characteristics.

SUMMARY OF THE INVENTION

The present invention is directed to a method of manufacturing coils having substantially predetermined resistance characteristics. The method comprises the following steps the resistance of at least one wire section forming a coil is measured and a measuring signal is generated indicative thereof; the measuring signal is supplied to an evaluating configuration; the measured resistance value is compared to a preselected desired value; if the measured resistance value exceeds the preselected desired resistance value, a braking signal is generated and transmitted to a braking element of the winding machine, in order to correspondingly decrease the braking action, and if the desired value is undershot, a braking signal is generated and transmitted to a braking element to correspondingly increase the braking action.

In known automatic winding machines, an increase in the braking action typically causes greater stretching of the wire due to the continued drawing of the wire, whereby the wire diameter is reduced As a result, the resistance of a length of the wire, and thus the resistance of a coil which is wound from that length of wire, increases. Accordingly, depending on the resistance of the wire used, the formation of areas of increased resistance within the wire is promoted by increasing the braking action and, in turn, stretching the wire. On the other hand, a reduction in the braking action decreases the amount that the wire is stretched and, thus, increases the wire diameter. This brings about a reduction in the formation of areas of increased resistance within the wire.

Thus, one advantage of the method of the present invention, is that it provides finished coils made of resistance wire, wherein each coil's electrical resistance falls within a narrow predetermined tolerance range, regardless of fluctuations in the resistance of the base wire used.

The method and apparatus of the present invention provide a relatively simple control loop which compensates for fluctuations in the resistance of the wires. Thus, it is possible to manufacture coils with precisely defined resistance characteristics. In accordance with one method of the present invention, while the resistance is measured, the coil temperature and/or the room temperature is measured. Based on the temperature measurement, the measured resistance value of the evaluating configuration is corrected. Thus, one advantage of the present invention is that it is possible to consistently produce coils with a desired resistance, regardless of the existing room temperature, which can otherwise have a considerable influence thereon.

The measurement of the coil temperature as such provides particularly accurate information which can be used to make corrections in the evaluating configuration. Due to the tensile stress and deformation caused by drawing the wire, the temperature of the wire can increase relative to the room temperature during the drawing process. Alternatively, the room temperature may change faster than the wire temperature due, for example, to drafts and/or sunshine entering the room. Since the room temperature can be measured rather easily, and no direct measurement is required, the room temperature provides a good measurement to be used for start-up and calibration of the apparatus of the present invention.

One method of the present invention also comprises the steps of measuring the resistance of several sections of wire being formed into a coil. Based on these measurements, the mean value thereof is calculated. The mean value is then compared to the preselected desired value, and the braking force of the braking element is correspondingly adjusted based on this comparison. By using the mean resistance value, the braking control adjustments are moderated to the extent that resistance variations limited to very short sections of the wire are ignored.

In accordance with one method of the present invention, in order to ensure that coils which fail to conform to required criteria, such as customer specifications, are not used, a signal for triggering a sorting process is emitted by the evaluating configuration in response to the detection of coils which have a resistance that falls outside of a preselected tolerance range.

The present invention is also directed to an apparatus for manufacturing coils. The apparatus comprises a coil winding machine, which includes a braking element that provides an electrically adjustable braking force. Since the braking force can be adjusted electrically, it is possible to incorporate this type of a braking element into an electrical control loop. The braking element preferably includes a magnetic particle brake which permits relatively sensitive adjustments of the braking force within a requisite correcting range. One such brake is available from Jaeger-Merobel/Paris, Model FAS20.

The apparatus of the present invention further comprises a resistance measuring device including a constant current source coupled to two measuring electrodes. The resistance measuring device also includes a digital volt meter, having a high internal resistance, which is coupled to two additional electrodes. Thus, the resistance measuring device has a "4-probe configuration," which provides a very accurate measurement of the coil's resistance. The resulting digitally measured resistance value is well suited for conversion within the processor-controlled evaluation device.

An apparatus of the present invention further comprises an infrared measuring head for measuring the surface temperature of the coil, and a room temperature sensor for measuring the ambient temperature of the coil. The infrared measuring head provides a measurement of the surface temperature of the coil from which an average wire temperature can be mathematically determined therefrom. The room temperature sensor can be used as a contact thermometer for calibration of the apparatus. The average wire temperature can be determined using both the room and surface temperatures.

Other features, advantages and details of the apparatus and method of the present invention will become apparent in view of the following detailed description and drawings taken in connection therewith.

DETAILED DESCRIPTION

Figure 1:
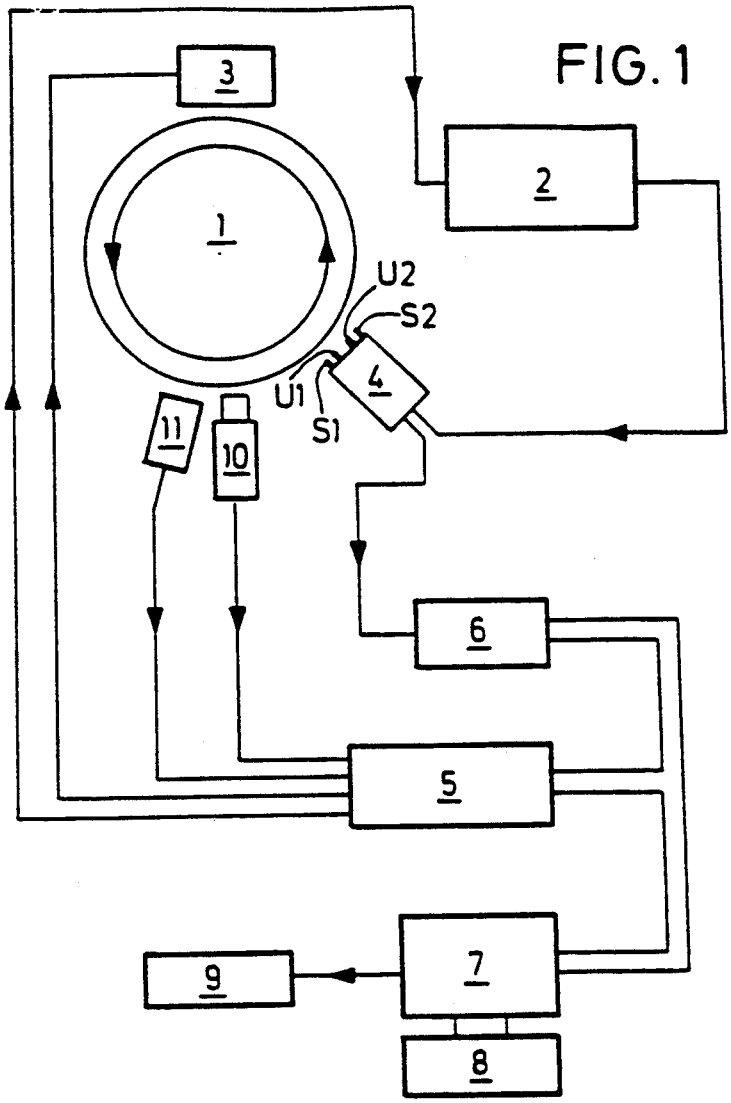
FIG. 1 is a schematic, block diagram of an apparatus embodying the present invention.

In FIG. 1 an apparatus embodying the present invention comprises a conventional automatic winding machine including a rotary table 1 for winding coils thereon. The apparatus further comprises a control system 2 coupled to the automatic winding machine. The control system 2 controls the winding machine and, thus, the process of drawing and cutting the wire. The winding machine also comprises a braking element 3, for restraining the wire in the direction of travel thereof.

A device 4 is coupled to the control system 2 for measuring the coil resistance by means of a 4-probe configuration. The device 4 therefore includes two external current probes S1 and S2 and two internal current probes U1 and U2. A constant current is generated by a multi-purpose device 5, which also serves to couple together the other components of the apparatus, as shown in FIG. 1. Thus, the multi-purpose device 5 is coupled to the braking element 3 and to the control system 2. A digital measuring device 6, which is preferably a digital volt meter, is coupled between the device 4 and the multi-purpose device 5. The digital measuring device 6 measures the voltage across the coil which is, accordingly, proportional to the resistance thereof.

An evaluating configuration 7 is coupled to the multi-purpose device 5 and the digital measuring device 6 and comprises a computer including a program input 8 and a printer 9. An infrared measuring head 10 is coupled to the multi-purpose device 5 and is provided to measure the surface temperature of the coil being wound. Thus, the measuring head 10 generates an output signal to the multi-purpose device 5, indicative of the surface temperature of the coil. The room temperature (or ambient temperature of the coil), on the other hand, is measured by a temperature sensor 11, which generates output signals indicative thereof. The multi-purpose device 5 is coupled to the temperature sensor 11 to receive the temperature signals therefrom.

Figure 2:
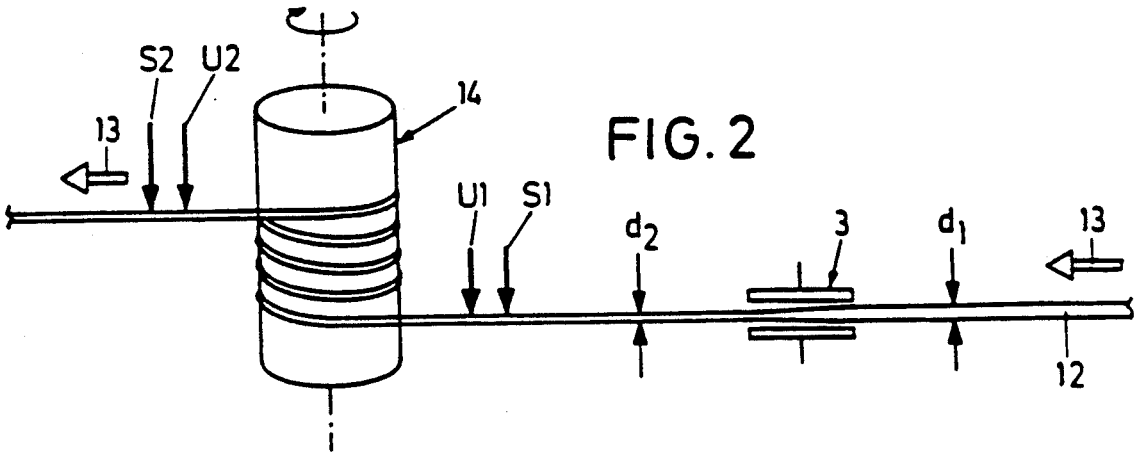
FIG. 2 is a schematic illustration of a wire being processed in the apparatus of FIG. 1 in accordance with the method of the present invention.

In FIG. 2, an alloyed resistance wire 12 is shown being drawn in the automatic winding machine of the apparatus of FIG. 1. The apparatus and method of the present invention are particularly applicable for wires having diameters within the range of 0.08 to 0.6 mm and, in particular, brass wire. Although the wire 12 is an alloyed wire, the apparatus and method of the present invention are equally applicable for manufacturing coils made of non-alloyed wires.

The wire 12 is drawn from a wire supply (not shown) in the direction of the arrows 13. The winding machine comprises a winding cylinder 14 on which the wire 12 is wound. The braking element 3 is located between the wire supply and the cylinder 14. The braking element 3 is actuated by the control system 2, through the multi-purpose device 5, to set a defined initial stress within the wire 12 to initiate the winding process thereof. Due to the tensile stress in the wire caused by the braking action of the braking element 3, and the drawing force on the wire, the wire 12 is stretched in the direction of the arrows 13. As a result, the diameter of the wire 12 is reduced from a first diameter $d_1$ to a second diameter $d_2$.

The resistance of the coil is measured by the measuring device 6 immediately upon winding, in accordance with the "4-probe method", based on the output of the two external current probes S1 and S2, and the two internal current probes U1 and U2 of the device 4. Use of the infrared measuring head 10 provides the measured surface temperature of the coil in a form proportional to the utilized range of the measuring head's output current. This feature has the advantage of permitting both easy calibration of the measuring head and evaluation of its output signal. Thus, the measured resistance value can be corrected as a function of the surface temperature of the coil.

In the operation of the apparatus and method of the present invention, before starting production, the infrared measuring head 10 is calibrated using the surface temperature of the wire 12 as a reference temperature. The surface temperature of the wire 12 is preferably obtained by contacting the wire with the temperature sensor 11 which, in turn, generates an output signal indicative thereof. Then, the output signal of the temperature sensor 11 is compared to the output signal of the measuring head 10 to calibrate the measuring head.

Once the infrared measuring head 10 is calibrated, the approximate average temperature of the coil can be determined through use of the surface temperature of the wire, as indicated by the infrared measuring head 10, and the room temperature (or ambient temperature of the wire), as indicated by the temperature sensor 11. The approximate average temperature of the coil can be calculated as follows: the measured surface temperature is added to the difference between the surface temperature and room temperature, which is multiplied by a temperature correcting factor. Then, based on the average temperature, the measured resistance value is correspondingly adjusted to, in turn, adjust the braking force of the braking element 3. Thus, the braking force is adjusted to compensate for variations in the temperature and, therefore, the resistance of the wire. Thus, by means of this temperature standardization, a coil with substantially predetermined resistance characteristics can be manufactured regardless of particular manufacturing conditions.

Most known methods and apparatus for manufacturing coils typically comprise 8 stations. Accordingly, the apparatus and method of the present invention can be suitably adapted to process eight coils. The resistance of each coil is measured by a measuring device 6 and a device 4. The resistance value of each coil is then supplied to the evaluating configuration 7 which, in turn, calculates a mean value for the eight coils. The mean value is used as the actual resistance value, which is compared to the preselected desired resistance value. The desired resistance value of the coils is the arithmetic mean of the maximum and minimum resistance values used to define the tolerance range of the coil resistance.

Then, the current of the braking element 3 and, thus, the braking force thereof, is correspondingly adjusted by the control system 2. The adjustment is based on the comparison between the actual mean resistance value and the desired resistance value, according to the following equation:

$$I_{new} = I_{old} + (R_{desired} - R_{actual}) * P$$

wherein:

$I_{new}$ is the new current of braking element 3;

$I_{old}$ is the old current of braking element 3;

$R_{desired}$ is the preselected desired coil resistance value;

$R_{actual}$ is the calculated mean coil resistance value; and

P is a control factor.

After this calculation and correction of the actual resistance value, a series of coils, i.e., seven coils, can be produced without recording a measured value. Then, another recording of the actual value is taken and the process is repeated.

It is also possible in accordance with the present invention to measure the resistance values, as described above, of several sections of the wire 12 being wound into a coil. Then, the evaluating configuration 7 calculates a mean value of the several measured resistance values. The evaluating configuration 7 then compares the mean value to the preselected desired value. Then, based on the difference between the mean value and the preselected desired value, the control system 2 correspondingly adjusts the braking force of the braking element 3 to obtain the desired resistance value.

The method and apparatus of the present invention have the advantage of producing finished coils of higher quality than the coils produced by other methods. Regardless of the processing temperature, the apparatus and method of the present invention have the advantage of reducing variances in the resistance values of the coils produced. Another particular advantage of the present invention is that it permits the processing of coils made of base wire having relatively large fluctuations in its resistance. Additionally, because of the type of braking element used, the apparatus has the advantage of operating virtually maintenance free.

In some instances, it may not be possible to achieve a desired resistance value because, for example, the alloy of the wire is substantially non-homogeneous. In such a case, in accordance with the method of the present invention, the winding device is controlled to either increase or decrease the number of windings of a particular coil, depending on whether the coil's resistance should be increased or decreased, respectively. Nevertheless, for precision adjustment, the control system is maintained by adjusting the braking force of the braking element 3.

It is also possible in accordance with the present invention for the evaluating configuration 7 to compare the measured resistance value of the wire 12 to a tolerance range of values (or i.e., maximum and minimum values), and to generate an alarm signal if the measured resistance value falls outside of the tolerance range. The tolerance range can be set, for example, based on a customer's specifications.

We claim:

1. A method of manufacturing coils having substantially predetermined resistance characteristics from resistance wire, comprising the following steps:

winding the resistance wire into a coil in a coil winding machine;

applying a braking force to the wire with an electrically controlled wire braking element prior to coiling the wire in the winding machine;

measuring the resistance value of at least one section of the wire as it is wound into a coil;

comparing the measured resistance value to a preselected desired value and, if the measured resistance value exceeds the preselected desired value, decreasing the braking force applied by the braking element to correspondingly decrease the degree to which the wire is stretched by the braking element and, in turn, correspondingly decrease the resistance of the wire, and if the measured resistance value is less than the preselected desired value, increasing the braking force applied by the braking element to correspondingly increase the degree to which the wire is stretched by the braking element and, in turn, correspondingly increase the resistance of the wire, thus producing coils having substantially predetermined electrical resistance characteristics.

2. A method as defined in claim 1, further comprising the following steps:

measuring the surface temperature and/or the ambient temperature of the coil; and comparing the value of the temperature measurement to the value of the resistance measurement and adjusting the value of the resistance measurement based thereon.

3. A method as defined in claim 1, further comprising the following steps:

measuring the resistance values of several sections of the wire being wound into a coil; calculating the mean value of the measured resistance values; and using the mean value as the measured resistance value to compare against the preselected desired value.

4. A method as defined in claim 1, further comprising the following steps:

comparing the measured resistance value to a preselected range of resistance values, and if the measured resistance value falls outside of the preselected range of values, generating an alarm signal to reject the respective coil.

5. A method as defined in claim 1, further comprising the following steps:

comparing the measured resistance value to preselected maximum and minimum resistance values, and if the measured resistance value is greater than the maximum resistance value, correspondingly decreasing the number of windings of the coil to correspondingly decrease the resistance thereof, and if the measured resistance value is less than the minimum resistance value, correspondingly increasing the number of windings of the coil to correspondingly increase the resistance thereof.

6. A method as defined in claim 1, wherein the resistance wire is simultaneously wound into a plurality of coils;

the resistance value of at least one section of the wire of each coil being wound is measured; and a mean resistance value is calculated from the plurality of measured resistance values, and the means resistance value is used as the measured resistance value to compare against the preselected desired value.

7. A method as defined in claim 6, wherein the desired resistance value is the mean value of the maximum and minimum values defining the tolerance range of the resistance of the coils.

8. A method as defined in claim 6, wherein the braking force of the braking element is controlled by adjusting the level of electric current flowing therethrough in accordance with the following equation:

$$I_{new} = I_{old} + (R_{desired} - R_{actual}) * P$$

wherein $I_{new}$ is the new level of electric current, $I_{old}$ is the previous level of electric current, $R_{desired}$ is the preselected desired coil resistance value, $R_{actual}$ is the mean measured resistance value, and P is a control factor.

9. An apparatus for manufacturing coils having substantially predetermined resistance characteristics from resistance wire, comprising:

a coil winding device for winding resistance wire thereon into a coil;

an electrically controlled braking member for applying a braking force to the wire prior to being wound into a coil on the coil winding device;

first means for measuring the resistance of at least one section of the wire being wound into a coil and for generating a first output signal indicative thereof; and a control unit coupled to the first means and to the braking member to compare the first output signal to a predetermined value indicative of the desired resistance value of the coil, and if the first output signal exceeds the predetermined value, the control unit controls the braking member to correspondingly decrease the braking force and, in turn, correspondingly decrease the degree to which the wire is stretched, and if the first output signal falls below the predetermined value, the control unit controls the braking member to correspondingly increase the braking force and, in turn, correspondingly increase the degree to which the wire is stretched, thus producing coils having substantially predetermined electrical resistance characteristics.

10. An apparatus for manufacturing coils as defined in claim 9, further comprising:

second means coupled to the control unit for measuring the surface temperature and/or the ambient temperature of at least one section of a wire being wound into a coil and for generating a second output signal indicative thereof; and wherein the control unit is responsive to the second output signal for adjusting the value of the first output signal based thereon to, in turn, compensate for any variations in the surface and/or ambient temperature of the wire.

11. An apparatus as defined in claim 10, wherein the first means includes:

a first measuring device including a first pair of current probes supported in contact with a wire being wound into a coil, and a second pair of current probes supported in contact with a wire being wound into a coil, the two pairs of current probes generating output signals indicative of the resistance of the section of wire in contact therewith; and a second measuring device coupled to the first measuring device and to the control unit, the second measuring device being responsive to the output signals generated by the first measuring device to generate a first output signal indicative of the resistance of the section of the wire.

12. An apparatus as defined in claim 11, wherein the second measuring device is a voltmeter and the first output signal is a voltage signal indicative of the resistance of the section of the wire.

13. An apparatus as defined in claim 11, wherein the second means includes:

an infrared measuring device coupled to the control unit and supported for measuring the surface temperature of at least one section of the wire and for generating a second output signal indicative thereof to the control unit.

14. An apparatus as defined in claim 13, wherein the second means further includes:

a temperature sensor coupled to the control unit and supported for measuring the ambient temperature of the wire being wound into a coil and for generating a second output signal indicative thereof to the control unit.

15. An apparatus as defined in claim 9, wherein the braking member is a magnetic particle brake.

16. An apparatus for winding wire coils having substantially predetermined electrical resistance characteristics, comprising:

a winding device for winding wire into coils;

a braking device for applying a braking force to a wire being wound into a coil on the winding device, to stretch the wire for adjusting the electrical resistance characteristics thereof;

first means for measuring the resistance of at least one section of a wire being wound into a coil on the winding device and for generating output signals indicative thereof; and second means coupled to the first means and to the braking device for controlling the force applied by the braking device to a wire being wound on the winding device, wherein, the second means compares the output signals of the first means to a predetermined value based on the desired resistance value of the coil, and correspondingly adjusts the braking force applied to the wire to, in turn, adjust the resistance of the wire to obtain coils having substantially predetermined resistance characteristics.

17. An apparatus as defined in claim 16, wherein the second means correspondingly increases the braking force in response to the output signals of the first means falling below the predetermined value to, in turn, correspondingly increase the resistance of the coil, and the second means correspondingly decreases the braking force in response to the output signals of the first means exceeding the predetermined value to, in turn, correspondingly decrease the resistance of the coil.

18. An apparatus as defined in claim 16, further comprising:

third means coupled to the second means for measuring the surface temperature and/or the ambient temperature of at least one section of a wire being wound into a coil on the winding device and for generating an output signal indicative thereof, the second means being responsive to the output signals of the third means to adjust the value of the output signal of the first means to compensate for variations in the surface and/or ambient temperature of the wire.

19. An apparatus as defined in claim 16, wherein the third means includes:

a first temperature measuring device coupled to the second means and supported for measuring the surface temperature of at least one section of a wire being wound into a coil on the winding device, and for generating an output signal indicative thereof; and a second temperature measuring device coupled to the second means and supported for measuring the ambient temperature of a wire being wound into a coil on the winding device and for generating an output signal indicative thereof.

20. An apparatus as defined in claim 16, wherein the first means includes:

a first resistance measuring device including two pairs of current probes supported in contact with at least one section of a wire being wound into a coil on the coil winding device, the two pairs of current probes generating output signals indicative of the resistance of the section of wire in contact therewith; and a voltmeter coupled to the first resistance measuring device and to the second means, the voltmeter being responsive to the output signals generated by the first resistance measuring device to generate output signals indicative of the resistance of the section of the wire.

21. An apparatus as defined in claim 16, wherein the first means measures the resistance of several sections of a wire being wound into a coil on the coil winding device and generates output signals indicative thereof; and the second means calculates the mean value of the output signals of the first means indicative of the resistance of several sections of a wire, and compares the mean value to the predetermined value.

22. An apparatus as defined in claim 16, wherein the winding device simultaneously winds wire into a plurality of coils;

the first means measures the resistance value of at least one section of the wire of each coil being wound and generates output signals indicative thereof; and the second means calculates a mean resistance value based on the output signals of the first means, and compares the means resistance value to the predetermined value.

* * * * *